US009932193B2

(12) United States Patent
Tomioka et al.

(10) Patent No.: US 9,932,193 B2
(45) Date of Patent: Apr. 3, 2018

(54) IMAGE FORMING APPARATUS, RECORDING MEDIUM TRANSPORTING DEVICE, AND IMAGE FORMING SYSTEM

(71) Applicant: FUJI XEROX CO., LTD., Tokyo (JP)

(72) Inventors: Hiromitsu Tomioka, Yokohama (JP); Riwako Miyauchi, Yokohama (JP); Kohei Takahashi, Yokohama (JP); Mizuki Arai, Yokohama (JP)

(73) Assignee: FUJI XEROX CO., LTD., Minato-Ku, Tokyo (JP)

( * ) Notice: Subject to any disclaimer, the term of this patent is extended or adjusted under 35 U.S.C. 154(b) by 0 days.

(21) Appl. No.: 15/134,644

(22) Filed: Apr. 21, 2016

(65) Prior Publication Data

US 2017/0108811 A1 Apr. 20, 2017

(30) Foreign Application Priority Data

Oct. 15, 2015 (JP) ..... 2015-203723

(51) Int. Cl.
*B65H 29/60* (2006.01)
*B65H 31/24* (2006.01)
(Continued)

(52) U.S. Cl.
CPC ..... *B65H 29/60* (2013.01); *B65H 31/24* (2013.01); *B65H 85/00* (2013.01); *G03G 15/234* (2013.01);
(Continued)

(58) Field of Classification Search
CPC ..... B65H 29/60; B65H 2301/448; B65H 2301/4482; B65H 2301/44822;
(Continued)

(56) References Cited

U.S. PATENT DOCUMENTS 8,684,487 B2 * 4/2014 Imoto ..... B41J 3/44 347/16
8,807,564 B2 * 8/2014 Reidhaar ..... B65H 85/00 271/186
(Continued)

FOREIGN PATENT DOCUMENTS

JP 10-338404 A 12/1998
JP 2000-327201 A 11/2000

*Primary Examiner* — Patrick Cicchino
(74) *Attorney, Agent, or Firm* — Sughrue Mion, PLLC

(57) ABSTRACT

An image forming apparatus includes an image forming section, a reverse transport portion that transports the recording medium in a reverse direction, which is opposite to a transport direction in which the recording medium is transported to the reverse transport portion from the image forming section, a first ejection portion to which the recording medium is ejected and that is disposed on a downstream side of a second transport path in the transport direction, the second transport path diverging from a first transport path along which the recording medium is transported from the image forming section to the reverse transport portion, and a reverse transport path along which the recording medium is transported from the reverse transport portion to the image forming section, the reverse transport path not overlapping a third transport path along which the recording medium is transported from the image forming section to the first ejection portion.

12 Claims, 9 Drawing Sheets

(51) Int. Cl.
*G03G 15/00* (2006.01)
*G03G 15/23* (2006.01)
*B65H 85/00* (2006.01)

(52) U.S. Cl.
CPC ..... *G03G 15/6529* (2013.01); *G03G 15/6573* (2013.01); *B65H 2301/31* (2013.01); *B65H 2301/448* (2013.01); *G03G 2215/0132* (2013.01)

(58) Field of Classification Search
CPC ..... B65H 2301/31; B65H 2301/312; B65H 2301/311; B65H 85/00; B65H 2404/50; G03G 15/6529
See application file for complete search history.

(56) References Cited

U.S. PATENT DOCUMENTS

| | | | | |
|---|---|---|---|---|
| 8,814,156 | B2 * | 8/2014 | Hattori | B65H 39/00 270/37 |
| 9,268,288 | B2 * | 2/2016 | Honda | G03G 15/6576 |
| 9,415,964 | B2 * | 8/2016 | Doi | B65H 29/125 |
| 9,438,758 | B2 * | 9/2016 | Fujiwara | G03G 15/6552 |
| 2010/0044949 | A1 * | 2/2010 | Nakamura | B65H 29/60 271/3.17 |
| 2015/0225201 | A1 * | 8/2015 | Watanabe | B65H 9/006 493/442 |
| 2015/0310315 | A1 * | 10/2015 | Ichihashi | B65H 1/04 358/1.12 |
| 2015/0321878 | A1 * | 11/2015 | Ichihashi | G03G 15/6514 271/3.19 |
| 2016/0368726 | A1 * | 12/2016 | Hayakawa | B65H 29/60 |

* cited by examiner

IMAGE FORMING APPARATUS, RECORDING MEDIUM TRANSPORTING DEVICE, AND IMAGE FORMING SYSTEM

CROSS-REFERENCE TO RELATED APPLICATIONS

This application is based on and claims priority under 35 USC 119 from Japanese Patent Application No. 2015-203723 filed Oct. 15, 2015.

BACKGROUND

Technical Field

The present invention relates to image forming apparatuses, recording medium transporting devices, and image forming systems.

SUMMARY

According to an aspect of the invention, an image forming apparatus includes an image forming section that forms an image on a recording medium, a reverse transport portion that transports the recording medium in a reverse direction, which is opposite to a transport direction in which the recording medium is transported to the reverse transport portion from the image forming section, a first ejection portion to which the recording medium is ejected and that is disposed on a downstream side of a second transport path in the transport direction, the second transport path diverging from a first transport path along which the recording medium is transported from the image forming section to the reverse transport portion, and a reverse transport path along which the recording medium is transported from the reverse transport portion to the image forming section, the reverse transport path not overlapping a transport path along which the recording medium is transported from the image forming section to the first ejection portion.

BRIEF DESCRIPTION OF THE DRAWINGS

An exemplary embodiment of the present invention will be described in detail based on the following figures, wherein.

DETAILED DESCRIPTION

Description on Image Forming System

Referring now to the appended drawings, an exemplary embodiment of the invention is described in detail below.

Figure 1:
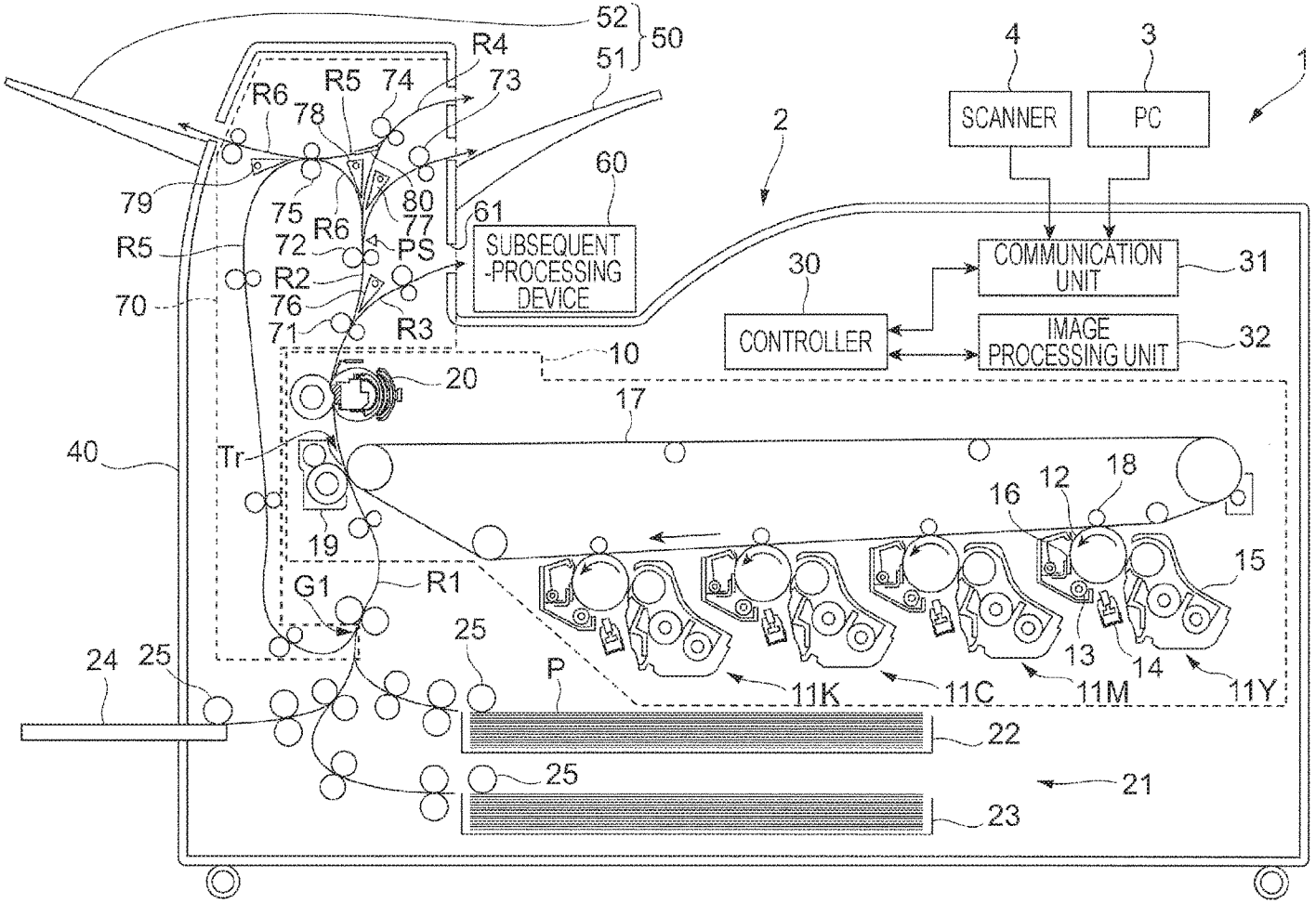
FIG. 1 is an entire configuration diagram of an image forming system according to an exemplary embodiment.
Figure 2:
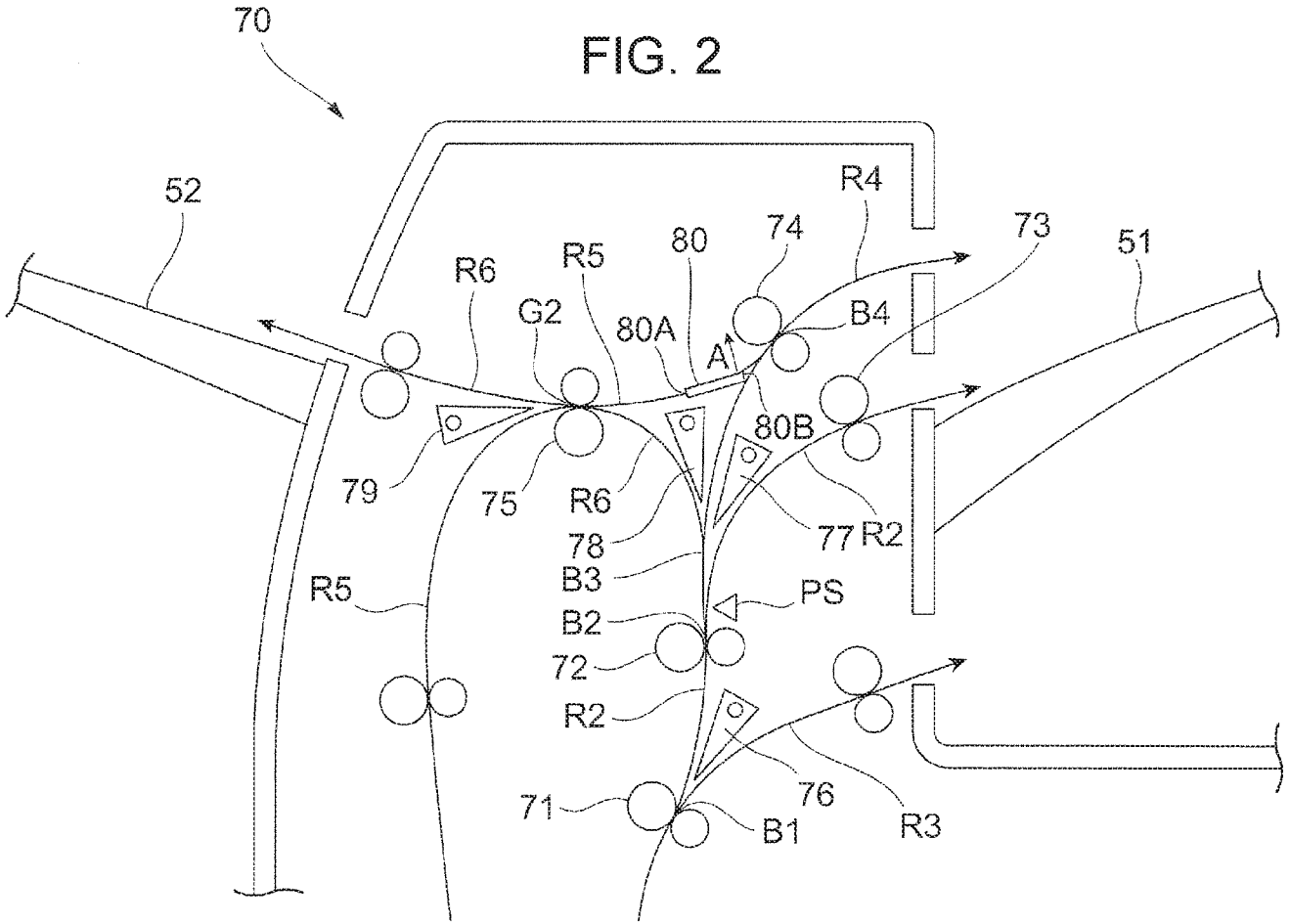
FIG. 2 is an enlarged diagram of a sheet transporting section.

FIG. 1 is an entire configuration diagram of an image forming system 1 according to an exemplary embodiment. FIG. 2 is an enlarged diagram of transport paths, in the image forming system 1, for sheets P on which images have been formed.

The image forming system 1 illustrated in FIG. 1 is a so-called tandem color printer. The image forming system 1 includes an image forming section 10, which forms images on the basis of image data, and a sheet feeding section 21, which feeds sheets P to the image forming section 10.

The image forming system 1 also includes a sheet transporting section 70, which transports sheets P on which images have been formed by the image forming section 10, and sheet ejection portions 50, to which the sheets P on which images have been formed are ejected. The image forming system 1 also includes a subsequent-processing device 60 disposed to the right of the sheet transporting section 70 in FIG. 1. The subsequent-processing device 60 includes components such as a sheet stacking unit, which receives and bundles sheets P on which images have been formed, and a fastening unit, which fastens sheets P together at the end portions of the sheets P. The image forming system 1 also includes an ejection port 61, through which the sheets P on which images have been formed are ejected to the subsequent-processing device 60.

The image forming system 1 also includes a housing 40 that accommodates and holds the image forming section 10, the sheet feeding section 21, and the sheet transporting section 70. The image forming system 1 also includes a controller 30, which controls the entire operation of the image forming system 1, a communication unit 31, which communicates with other devices such as a personal computer (PC) 3 or an image reading device (scanner) 4 and receives image data from the devices, and an image processing unit 32, which performs predetermined image processing on the image data received by the communication unit 31.

The sheet feeding section 21 includes a first sheet-feed tray 22 and a second sheet-feed tray 23, from which sheets P are fed to a first sheet-transport path R1. The first sheet-feed tray 22 and the second sheet-feed tray 23 have a similar configuration. The sheet feeding section 21 also includes a manual feed tray 24 used for manually feeding sheets P. The sheet feeding section 21 also includes pick-up rollers 25 disposed over the first sheet-feed tray 22, the second sheet-feed tray 23, and the manual feed tray 24 at positions downstream of the respective trays 22, 23, and 24 in the direction in which the sheets P are transported, or, a transportation direction. Each pick-up roller 25 picks up the sheets P and transports the sheets P to a second transfer position Tr of the image forming section 10 along the transport path extending from the corresponding tray 22, 23, or 24. The transport paths extending from the first sheet-feed tray 22, the second sheet-feed tray 23, and the manual feed tray 24 merge with one another at a merging point G1, which is an upstream end of the first sheet-transport path R1.

The image forming section 10 includes four image forming units 11Y, 11M, 11C, and 11K (hereinafter collectively referred to as image forming units 11) for yellow (Y), magenta (M), cyan (C), and black (K), disposed in parallel at regular intervals. Each image forming unit 11 includes a photoconductor drum 12, which allows an electrostatic latent image to be formed thereon and holds a toner image, a charging device 13, which charges the surface of the photoconductor drum 12 with electricity, and an exposure device 14, which exposes the photoconductor drum 12 charged by the charging device 13 with light on the basis of image data. Each image forming unit 11 also includes a developing device 15, which develops an electrostatic latent image formed on the photoconductor drum 12, and a cleaner 16, which cleans the surface of the photoconductor drum 12 after transfer.

The image forming section 10 also includes an intermediate transfer belt 17, onto which toner images of different colors formed on the photoconductor drums 12 of the respective image forming units 11 are transferred so as to be superposed one on top of another, first transfer rollers 18, which sequentially transfer (first-transfer) toner images of different colors of the corresponding image forming units 11 to the intermediate transfer belt 17, a second transfer roller 19, which collectively transfers (second-transfers) the superposed toner images transferred onto the intermediate transfer belt 17 to a sheet P, and a fixing device 20, which fixes the second-transferred images to the sheet P.

The sheet ejection portions 50 include an ejection tray 51, disposed on a first end portion of the sheet transporting section 70, and a side tray 52, disposed on a second end portion of the sheet transporting section 70 opposite to the end portion on which the ejection tray 51 is disposed.

The ejection tray 51 is disposed on the right side of the sheet transporting section 70 in FIG. 1. Sheets P subjected to single-side printing are ejected to the ejection tray 51 while their surfaces on which images are not formed face up. Here, the ejection tray 51 is an example of a first ejection portion and the ejection port 61 is an example of an ejection portion.

The side tray 52, which is an example of a second ejection portion, is disposed on the left side of the sheet transporting section 70 in FIG. 1. Sheets P subjected to single-side printing are ejected to the side tray 52 while their surfaces on which images are formed face up.

The image forming system 1 according to this exemplary embodiment is a so-called color printer, which forms images of colors Y, M, C, and K on a sheet P. The image forming system 1, however, is not limited to a color printer. The image forming system 1 may be, for example, a so-called monochrome printer, which forms monochrome images on a sheet P.

An image forming apparatus 2 according to this exemplary embodiment includes the image forming section 10, the sheet feeding section 21, the housing 40, the sheet transporting section 70, the sheet ejection portions 50, and the ejection port 61.

Description of Sheet Transporting Section

Subsequently, the sheet transporting section 70 that transports sheets P on which images have been formed is described.

The sheet transporting section 70, which is an example of a recording medium transporting device, includes first transport rollers 71, which transport sheets P on which images have been formed by the image forming section 10 downstream in the transportation direction, and second transport rollers 72, which transport the sheets P that have been transported thereto by the first transport rollers 71 further downstream in the transportation direction. The sheet transporting section 70 also includes third transport rollers 73, which transport the sheets P that have been transported thereto by the second transport rollers 72 toward the ejection tray 51, and reverse transport rollers 74, which transport the sheets P in a reverse direction, opposite to the direction in which the sheets P have been transported thereto by the second transport rollers 72. The sheet transporting section 70 also includes diverging rollers 75, which transport the sheets P transported thereto in the reverse direction by the reverse transport rollers 74 toward the side tray 52 or back to the image forming section 10.

The sheet transporting section 70 also includes a second sheet transport path R2, which extends upward from the image forming section 10 for transporting the sheets P to the ejection tray 51, and a third sheet transport path R3, which diverges rightward in FIG. 2 from the second sheet transport path R2 at a position between the first transport rollers 71 and the second transport rollers 72 for transporting the sheets P to the subsequent-processing device 60. The sheet transporting section 70 also includes a fourth sheet transport path R4, which diverges upward from the second sheet transport path R2 at a position downstream of the second transport rollers 72 in the transportation direction and is curved rightward in FIG. 2 for transporting the sheets P to the reverse transport rollers 74, and a fifth sheet transport path R5, which diverges leftward in FIG. 2 from the fourth sheet transport path R4 and extends downward for transporting the sheet P to a merging point G1 again. The fifth sheet transport path R5 is an example of a reverse transport path.

The sheet transporting section 70 also includes a sixth sheet transport path R6, which diverges leftward in FIG. 2 from the fourth sheet transport path R4 at a portion of the fourth sheet transport path R4 upstream of the reverse transport rollers 74 for transporting the sheets P to the side tray 52.

Although the fifth sheet transport path R5 and the sixth sheet transport path R6 cross each other in the middle of the transport paths, the paths R5 and R6 are separately provided.

The sheet transporting section 70 includes a first switching gate 76, which is disposed near a diverging point B1 between the second sheet transport path R2 and the third sheet transport path R3 and switches the transportation route of the sheets P between the second sheet transport path R2 and the third sheet transport path R3. The sheet transporting section 70 also includes a second switching gate 77, which is disposed near a diverging point B2 between the second sheet transport path R2 and the fourth sheet transport path R4 and switches the transportation route of the sheets P between the second sheet transport path R2 and the fourth sheet transport path R4. The sheet transporting section 70 also includes a third switching gate 78, which is disposed near a diverging point B3 between the fourth sheet transport path R4 and the sixth sheet transport path R6 and switches the transportation route of the sheets P between the fourth sheet transport path R4 and the sixth sheet transport path R6. The sheet transporting section 70 also includes a fourth switching gate 79, which is disposed near a merging point G2 at which the fifth sheet transport path R5 and the sixth sheet transport path R6 merge with each other and switches the transportation route of the sheets P between the fifth sheet transport path R5 and the sixth sheet transport path R6.

The sheet transporting section 70 also includes a one-way transport gate 80, which is disposed near the diverging point B4 between the fourth sheet transport path R4 and the fifth sheet transport path R5 and guides the sheets P to the downstream side of the fourth sheet transport path R4. The sheet transporting section 70 also includes a position sensor PS, which is disposed near the diverging point B2 and detects the leading ends of the sheets P transported by the second transport rollers 72 over the second sheet transport path R2.

The first transport rollers 71 transport sheets P on which images have been formed to the second sheet transport path R2 or the third sheet transport path R3.

The first switching gate 76 is disposed in such a manner as to be allowed to protrude over the second sheet transport path R2 and the third sheet transport path R3. When the transportation route of a sheet P transported by the first transport rollers 71 is to be switched to the third sheet transport path R3, the first switching gate 76 protrudes over the second sheet transport path R2 to guide the sheet P to the third sheet transport path R3. When, on the other hand, the transportation route of a sheet P is to be switched to the second sheet transport path R2, the first switching gate 76 protrudes over the third sheet transport path R3 to guide the sheet P to the downstream side of the second sheet transport path R2.

The second transport rollers 72 transport the sheet P, which the first switching gate 76 has been guiding to the second sheet transport path R2, to the downstream side of the second sheet transport path R2, to the fourth sheet transport path R4, or to the sixth sheet transport path R6.

The position sensor PS detects passing of the leading end of each sheet P transported by the second transport rollers 72 and, upon detection, transmits a detection signal to the controller 30. Upon receipt of the signal from the position sensor PS, the controller 30 acquires information on the position of the sheet P. The controller 30 thus controls transportation of sheets P so that a sheet P transported over the fifth sheet transport path R5 and another sheet P transported over the sixth sheet transport path R6 do not come into contact with each other.

The second switching gate 77 is disposed so as to be allowed to protrude over the second sheet transport path R2 and the fourth sheet transport path R4. When the transportation route of a sheet P transported by the second transport rollers 72 is to be switched to the fourth sheet transport path R4, the second switching gate 77 protrudes over the second sheet transport path R2 to guide the sheet P to the fourth sheet transport path R4. On the other hand, when the transportation route of a sheet P is to be switched to the second sheet transport path R2, the second switching gate 77 protrudes over the fourth sheet transport path R4 to guide the sheet P to the downstream side of the second sheet transport path R2.

The third transport rollers 73, which are examples of a transportation portion, include a pair of rollers, which are a pressing roller and a driving roller. The third transport rollers 73 transport the sheet P, which the second switching gate 77 guides to the second sheet transport path R2, toward the ejection tray 51.

The third switching gate 78 is disposed so as to be allowed to protrude over the fourth sheet transport path R4 and the sixth sheet transport path R6. When the transportation route of the sheet P transported by the second transport rollers 72 is to be switched to the sixth sheet transport path R6, the third switching gate 78 protrudes over the fourth sheet transport path R4 to guide the sheet P to the sixth sheet transport path R6. On the other hand, when the transportation route of the sheet P is to be switched to the fourth sheet transport path R4, the third switching gate 78 protrudes over the sixth sheet transport path R6 to guide the sheet P to the downstream side of the fourth sheet transport path R4.

The one-way transport gate 80, which is an example of a one-way guide portion, is continuous with a wall surface (not illustrated) constituting the fifth sheet transport path R5 at its first end 80A. A second end 80B of the one-way transport gate 80 is disposed on a wall surface (not illustrated) constituting the fourth sheet transport path R4 at a portion upstream of the diverging point B4. When a sheet P transported over the fourth sheet transport path R4 comes into contact with the one-way transport gate 80, the one-way transport gate 80 is pushed aside by the sheet P and elastically deformed in such a manner that its second end 80B moves in the direction of arrow A in FIG. 2. Thus, the transport path of the sheet P is ensured, so that the sheet P is allowed to be transported toward the reverse transport rollers 74.

On the other hand, even when the sheet P transported by the reverse transport rollers 74 in the reverse direction comes into contact with an upper portion of the one-way transport gate 80, the wall surface constituting the fourth sheet transport path R4 located below the one-way transport gate 80 restricts downward movement of the one-way transport gate 80. Thus, the second end 80B of the one-way transport gate 80 does not move. The sheet P is thus transported to the fifth sheet transport path R5 while being guided by the one-way transport gate 80.

The one-way transport gate 80 may have a configuration similar to that of the first switching gate 76. In this case, when a sheet P is to be transported over the fourth sheet transport path R4, the one-way transport gate 80 is retracted from the fourth sheet transport path R4. When the sheet P is to be transported over the fifth sheet transport path R5 in the reverse direction, the one-way transport gate 80 protrudes over the fourth sheet transport path R4 to guide the sheet P to the downstream side of the fifth sheet transport path R5.

The reverse transport rollers 74, which are examples of reverse transport portions, include a pair of rollers, that is, a pressing roller and a driving roller. The reverse transport rollers 74 rotate (forward) in such a direction that the sheet P transported over the fourth sheet transport path R4 is transported further downstream. The reverse transport rollers 74 also rotate in the reverse direction when the trailing end of the sheet P passes through the one-way transport gate 80 to transport the sheet P toward the fifth sheet transport path R5.

The diverging rollers 75, which are examples of divergent transport portions, are disposed at the merging point G2. The diverging rollers 75 transport the sheet P transported over the fifth sheet transport path R5 to the downstream side of the fifth sheet transport path R5. The diverging rollers 75 also transport the sheet P transported over the sixth sheet transport path R6 toward the side tray 52.

The fourth switching gate 79 is disposed so as to be allowed to protrude over the fifth sheet transport path R5 and the sixth sheet transport path R6. When the transportation route of a sheet P is to be switched to the sixth sheet transport path R6, the fourth switching gate 79 protrudes over the fifth sheet transport path R5 to guide the sheet P to the sixth sheet transport path R6. On the other hand, when the transport route of a sheet P is to be switched to the fifth sheet transport path R5, the fourth switching gate 79 protrudes over the sixth sheet transport path R6 to guide the sheet P to the downstream side of the fifth sheet transport path R5.

Description on State of Sheet Transportation when Operation of Double-Side Printing on Sheet and Operation of Single-Side Printing on Sheet and Transporting Sheet to Ejection Tray are Successively Performed The following describes the state of transportation of sheets P when a user sequentially enters multiple printing commands on the image forming system 1.

Figure 3C:
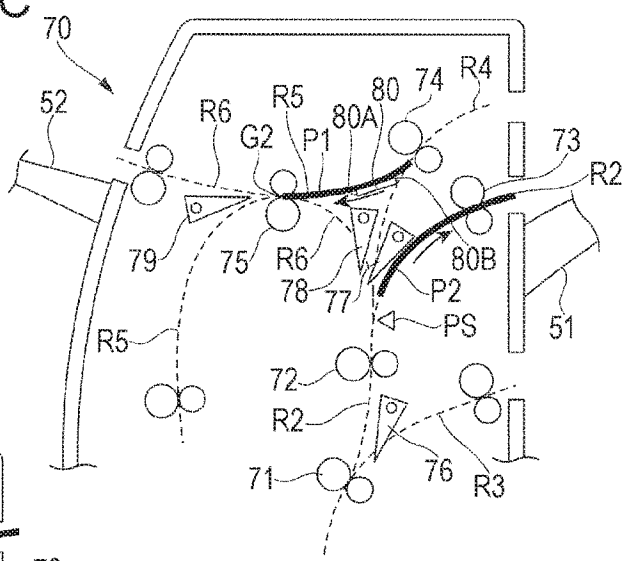
FIGS. 3A to 3C each illustrate the state of sheet transportation when an operation of double-side printing on a sheet and an operation of single-side printing on a sheet and then transporting the sheet to an ejection tray are successively performed.
Figure 3B:
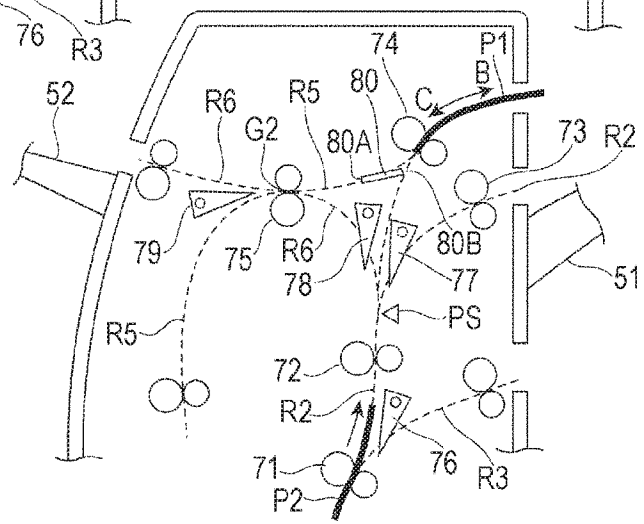
Figure 3A:
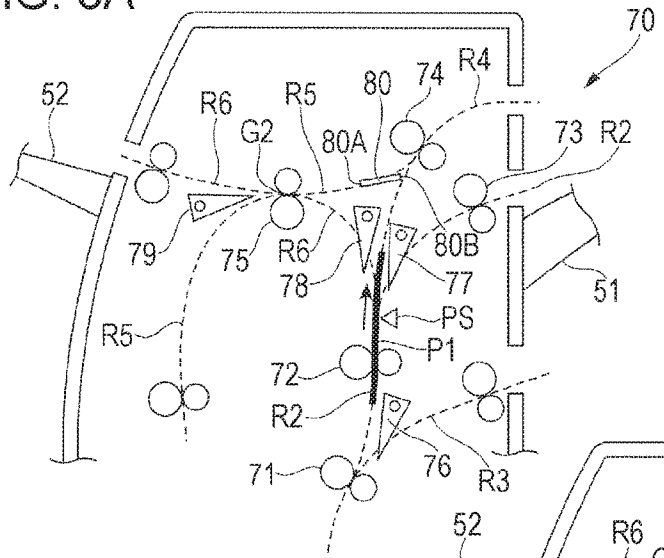

FIGS. 3A to 3C each illustrate the state of transportation of sheets P when a user sequentially enters, on the image forming system 1, a command of performing double-side printing on a sheet P and ejecting the sheet P to the ejection tray 51 and a command of performing single-side printing on a sheet P and ejecting the sheet P to the ejection tray 51.

First, upon receipt of a double-side printing command from the user, a first sheet P1 (hereinafter referred to as a sheet P1) fed from the sheet feeding section 21 is subjected to image formation on one side by the image forming section 10 and then transported by the first transport rollers 71 over the second sheet transport path R2. Then, as illustrated in FIG. 3A, the second transport rollers 72 transport the sheet P1. The position sensor PS detects passing of the leading end of the sheet P1. Here, the sheet P1 is kept being transported to the downstream side without being interrupted since no other sheets P are transported downstream of the sheet P1 in the transportation direction, so that the sheet P1 is prevented from coming into contact with other sheets P.

The second switching gate 77 protrudes over the second sheet transport path R2 to guide the sheet P1 to the fourth sheet transport path R4. The third switching gate 78 protrudes over the sixth sheet transport path R6 to guide the sheet P1 to the downstream side of the fourth sheet transport path R4.

Thereafter, the sheet P1 transported over the fourth sheet transport path R4 is transported to the downstream side while pushing the one-way transport gate 80 aside to ensure a gap between the one-way transport gate 80 and the fourth sheet transport path R4 through which the sheet P1 passes.

When the sheet P1 passes the one-way transport gate 80 and arrives at the reverse transport rollers 74, as illustrated in FIG. 3B, the rotation of the reverse transport rollers 74 is switched from forward rotation to reverse rotation. Thus, the transportation direction of the sheet P1 is reversed from the direction of arrow B in FIG. 3B to the direction of arrow C in FIG. 3B.

On the other hand, upon receipt of a single-side printing command from a user, a second sheet P2 (hereinafter referred to as a sheet P2) is subjected to image formation by the image forming section 10 and transported by the first transport rollers 71 over the second sheet transport path R2.

The position sensor PS detects the leading end of the sheet P2. Here, the sheet P1 is not located on the second sheet transport path R2 over which the sheet P2 is transported, so that the sheet P2 does not come into contact with the sheet P1. Thus, the sheet P2 is kept being transported to the downstream side without being interrupted.

Then, as illustrated in FIG. 3C, the second switching gate 77 protrudes over the fourth sheet transport path R4 to guide the sheet P2 to the downstream side of the second sheet transport path R2. Thereafter, the sheet P2 is ejected to the ejection tray 51.

The sheet P1, on the other hand, is transported over the fifth sheet transport path R5 by being guided by the one-way transport gate 80. The fourth switching gate 79 protrudes over the sixth sheet transport path R6 to guide the sheet P1 to the downstream side of the fifth sheet transport path R5. The diverging rollers 75 transport the sheet P1 to the downstream side of the fifth sheet transport path R5. Then, the sheet P1 passes the merging point G1 and then arrives at the second transfer position Tr of the image forming section 10 again.

Thereafter, the sheet P1 is subjected to image formation on a side on which an image has not been formed, that is, double-side printing, and then ejected to the ejection tray 51.

In this manner, the operation of the image forming system 1 performing double-side printing on the sheet P1 and ejecting the sheet P1 to the ejection tray 51 and the operation of the image forming system 1 performing single-side printing on the sheet P2 and ejecting the sheet P2 to the ejection tray 51 are finished.

In this exemplary embodiment, the second sheet transport path R2 used for transporting the sheets P to the ejection tray 51 and the fifth sheet transport path R5 used for transporting the sheets P in the reverse direction are separately provided and these paths do not overlap with each other. Thus, even when the operation of double-side printing on the sheet P1 and the operation of ejecting the sheet P2 subjected to single-side printing to the ejection tray 51 are successively performed, the sheet P1 and the sheet P2 do not touch each other. Thus, the transportation of the sheet P1 and the transportation of the sheet P2 are not interrupted. The same relationship is applicable to the case of a relationship between the sheet P1 transported in the reverse direction after being subjected to single-side printing and the sheet P2 transported to the ejection tray 51 after being subjected to double-side printing when the image forming system 1 successively performs double-side printing on sheets P and ejects the sheets P to the ejection tray 51.

Figure 4C:
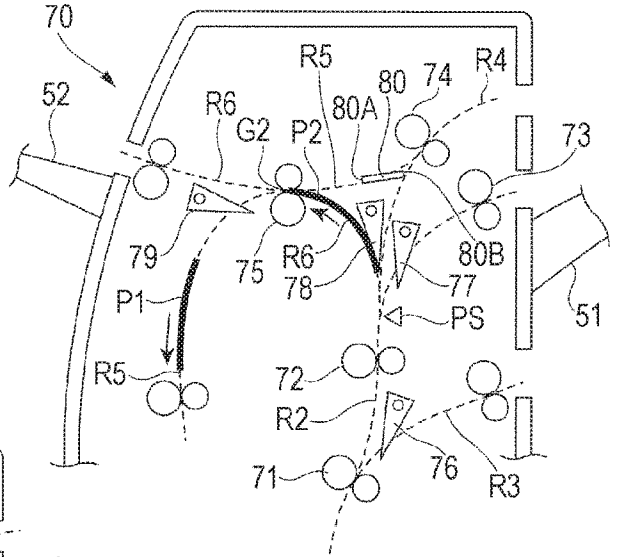
FIGS. 4A to 4C each illustrate the state of sheet transportation when an operation of double-side printing on a sheet and an operation of single-side printing on a sheet and then transporting the sheet to a side tray are successively performed.
Figure 4B:
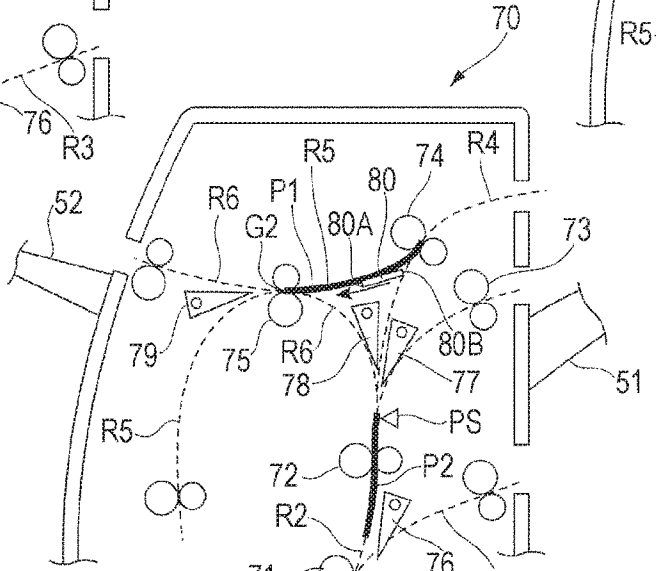
Figure 4A:
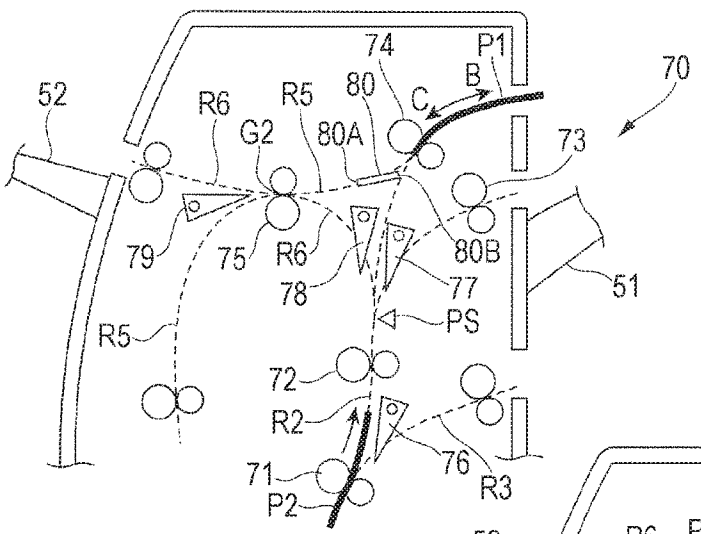

Description on State of Sheet Transportation when Operation of Double-Side Printing on Sheet and Operation of Single-Side Printing on Sheet and then Transporting Sheet to Side Tray are Successively Performed FIGS. 4A to 4C illustrate the states of transportation of the sheet P1 and the sheet P2 when a user successively enters, on the image forming system 1, a command of performing double-side printing on the sheet P1 and a command of performing single-side printing on the sheet P2 and ejecting the sheet P2 to the side tray 52.

First, as illustrated in FIG. 4A, when the sheet P1 subjected to image formation on one side arrives at the reverse transport rollers 74, the reverse transport rollers 74 reverse the transportation direction of the sheet P1. The sheet P2, on the other hand, is subjected to image formation on one side and then transported by the first transport rollers 71 over the second sheet transport path R2. The sheet transportation operations thus far are similar to the case illustrated in FIGS. 3A and 3B.

Thereafter, the position sensor PS detects the leading end of the sheet P2. At this time, if the sheet P2 is kept being transported without being interrupted, the sheet P1 transported over the fifth sheet transport path R5 and the sheet P2 transported over the sixth sheet transport path R6 come into contact with each other at the merging point G2.

Thus, as illustrated in FIG. 4B, the transportation of the sheet P2 performed by the second transport rollers 72 is interrupted. The sheet P1, on the other hand, is transported over the fifth sheet transport path R5 and arrives at the diverging rollers 75. Thereafter, the second transport rollers 72 restart transportation of the sheet P2 at such a timing that the sheet P2 does not come into contact with the sheet P1 at the merging point G2.

As illustrated in FIG. 4C, the sheet P2 is transported over the sixth sheet transport path R6 and arrives at the diverging rollers 75. At this time, the sheet P1 has already been transported over the fifth sheet transport path R5 at a position downstream of the diverging rollers 75. Thus, the sheet P1 and the sheet P2 are transported without coming into contact with each other. Thereafter, the sheet P2 is transported over the sixth sheet transport path R6 and ejected to the side tray 52.

The sheet P1 arrives at the second transfer position Tr again, at which the sheet P1 is subjected to image formation on a side on which an image has not been formed yet, and the sheet P1 is then ejected to the ejection tray 51 or the side tray 52.

In this manner, the operation of the image forming system 1 of performing double-side printing on the sheet P1 and the operation of the image forming system 1 of performing single-side printing on the sheet P2 and ejecting the sheet P2 to the side tray 52 are finished.

In this exemplary embodiment, the fifth sheet transport path R5 used for transporting the sheets P in the reverse direction and the sixth sheet transport path R6 used for transporting the sheets P to the side tray 52 overlap with each other only at the merging point G2 and do not overlap in the other region. Thus, in contrast to the case where a transport path on which a sheet P is transported in the reverse direction overlaps an ejection path on which a sheet P is transported in the opposite direction, the time period for which the transportation of either a sheet P that is to be transported in the reverse direction or a sheet P that is transported on the ejection path is interrupted is reduced.

The same relationship is applicable to the case of a relationship between the sheet P1 transported in the reverse direction after being subjected to single-side printing and the sheet P2 transported to the side tray 52 after being subjected to double-side printing when the image forming system 1 successively performs double-side printing on sheets P and ejects the sheets P to the side tray 52.

If, depending on the relationship between the sheet P1 transported over the fifth sheet transport path R5 in the reverse direction and the sheet P2 transported over the sixth sheet transport path R6, the sheet P2 arrives at the merging point G2 earlier than the sheet P1, the transportation of the sheet P2 does not have to be interrupted. In this case, the reverse transport rollers 74 stop transportation of the sheet P1 while holding the sheet P1. Then, the reverse transport rollers 74 restart transportation of the sheet P1 at such a timing that the sheet P1 does not come into contact with the sheet P2 at the merging point G2.

Figure 5:
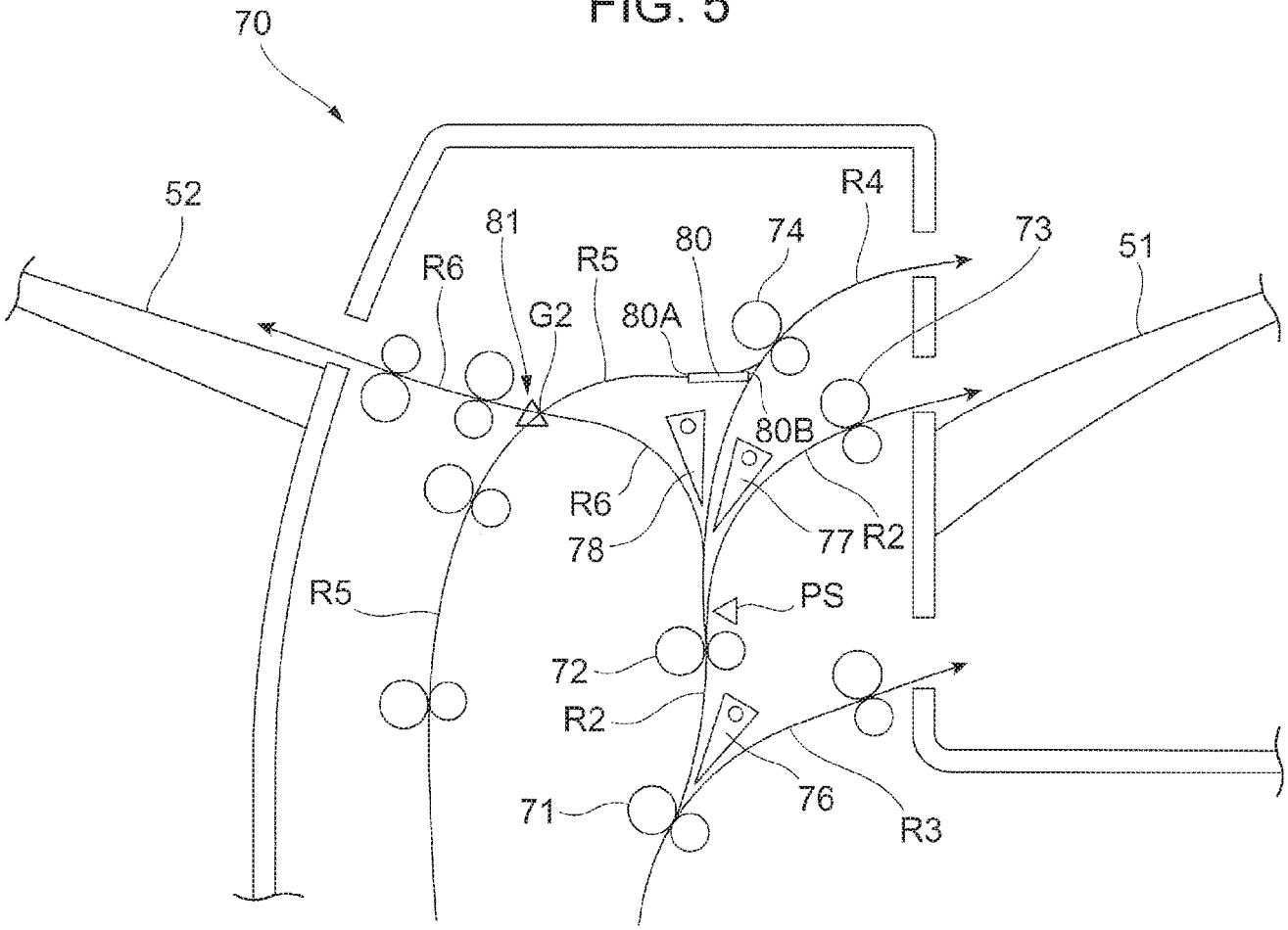
FIG. 5 illustrates another example of the configuration for switching sheet transport paths at a merging point at which a fifth sheet transport path and a sixth sheet transport merge with each other.

Another Configuration Example for Switching Between Sheet Transport Paths at Merging Point at which Fifth Sheet Transport Path and Sixth Sheet Transport Merge FIG. 5 illustrates another configuration example for switching transport paths for the sheets P at the merging point G2. Here, components having the same configuration as those illustrated in FIG. 2 are denoted by the same reference symbols.

In the configuration example illustrated in FIG. 5, the sheet transporting section 70 includes a rotary gate 81 disposed at the merging point G2 to guide the sheets P that have arrived at the merging point G2 to the downstream side. The rotary gate 81 has a triangular shape and rotates around the center of the triangle, using as the rotation axis. One side of the triangular rotary gate 81 protrudes over either the fifth sheet transport path R5 or the sixth sheet transport path R6 to restrict transportation of the sheets P to the sheet transport path over which it protrudes. The fourth switching gate 79 and the rotary gate 81 are examples of a transport path switching portion.

Figure 6A:
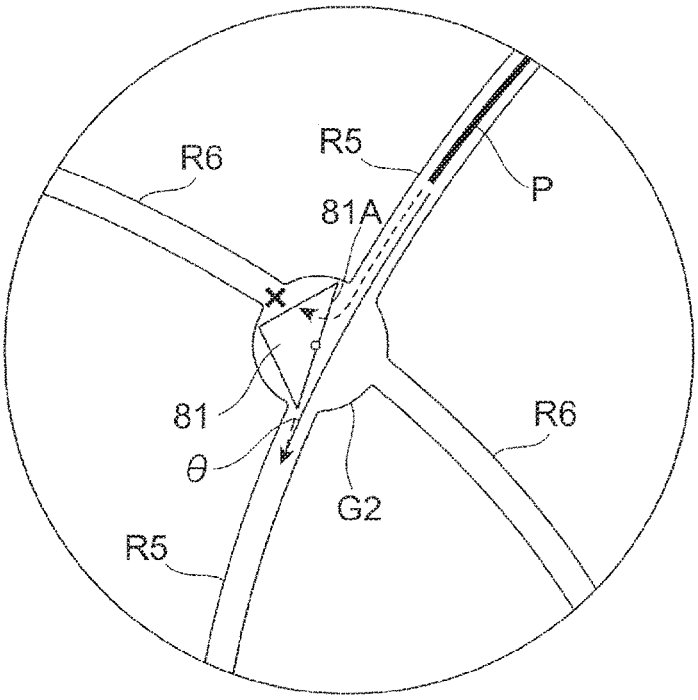
FIGS. 6A and 6B illustrate the operation of a rotary gate.
Figure 6B:
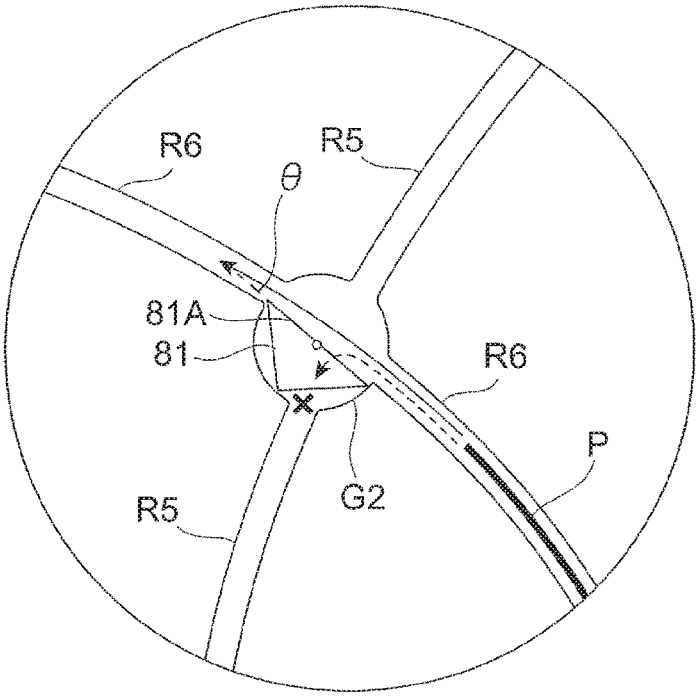

FIGS. 6A and 6B illustrate the operation of the rotary gate 81.

When, as illustrated in FIG. 6A, a sheet P is transported over the fifth sheet transport path R5 at a position upstream of the merging point G2, the rotary gate 81 rotates so that one side 81A of the rotary gate 81 protrudes over the sixth sheet transport path R6. Here, the one side 81A of the rotary gate 81 extends toward a portion of the fifth sheet transport path R5 downstream of the merging point G2.

Here, an angle θ formed by the one side 81A and the fifth sheet transport path R5 at the merging point G2 is an acute angle. Thus, even when the sheet P transported over the fifth sheet transport path R5 is directed to the side of the sixth sheet transport path R6 downstream of the merging point G2, the one side 81A restricts the transportation of the sheet P to the sixth sheet transport path R6. Thus, the one side 81A guides the sheet P to the downstream side of the fifth sheet transport path R5.

When, as illustrated in FIG. 6B, a sheet P is transported over the sixth sheet transport path R6 at a position upstream of the merging point G2, the rotary gate 81 rotates so that the one side 81A protrudes over the fifth sheet transport path R5. Here, an angle θ formed by the one side 81A and the sixth sheet transport path R6 at the merging point G2 is an acute angle. Thus, even when the sheet P transported over the sixth sheet transport path R is directed to the side of the fifth sheet transport path R5 downstream of the merging point G2, the one side 81A restricts the transportation of the sheet P to the fifth sheet transport path R5. Thus, the one side 81A guides the sheet P to the downstream side of the sixth sheet transport path R6.

In this exemplary embodiment, the rotary gate 81 is disposed at the merging point G2 and switches the transportation of the sheets P between the fifth sheet transport path R5 and the sixth sheet transport path R6. Thus, compared to the case where the diverging rollers 75 are disposed at the merging point G2, the radii of curvature of the fifth sheet transport path R5 and the sixth sheet transport path R6 at the merging point G2 are allowed to be increased. Increasing the radii of curvature of the sheet transport paths at the merging point G2 allows the sheets P to be less likely to be curved or more smoothly transported when the sheet P passes the merging point G2.

Figure 7A:
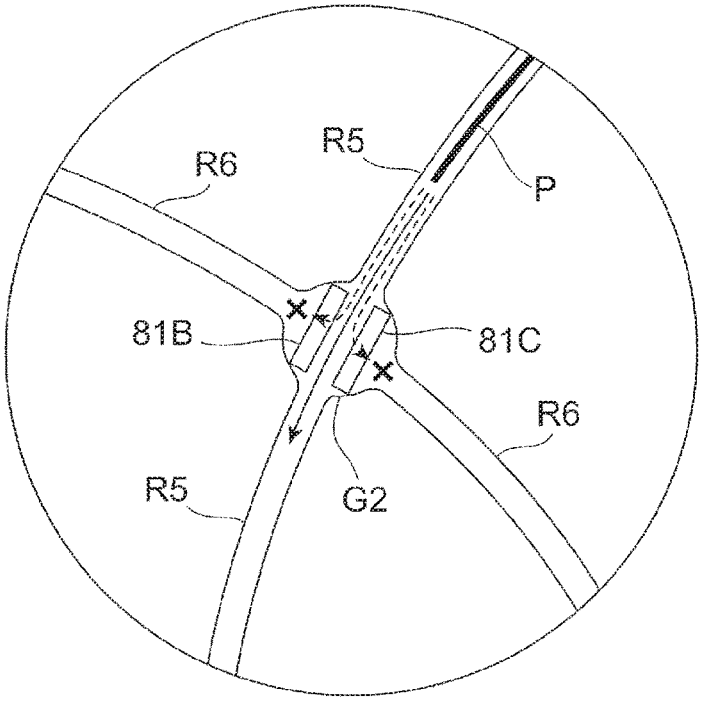
FIGS. 7A and 7B illustrate the operation of a rotary gate having another configuration.
Figure 7B:
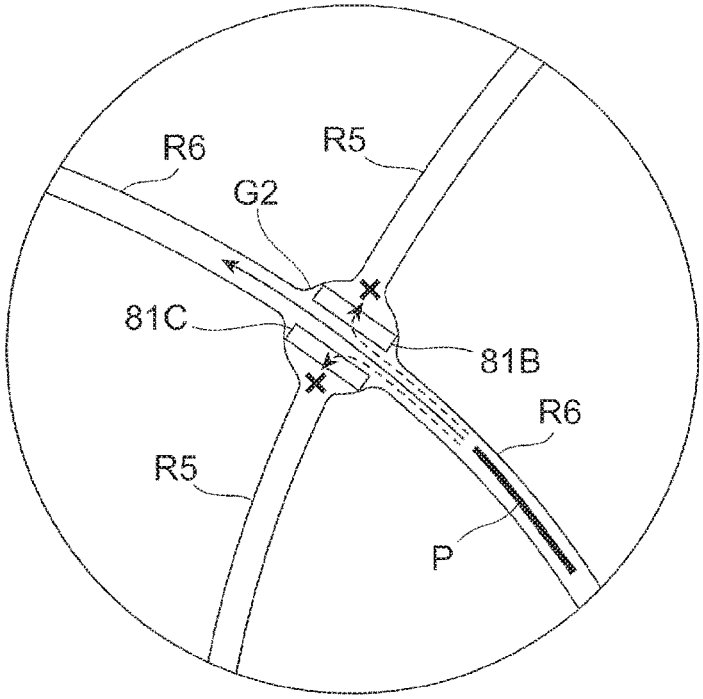

FIGS. 7A and 7B illustrate another example of the configuration of the rotary gate 81.

The rotary gate 81 illustrated in FIGS. 7A and 7B includes a rotation shaft and a gate plate 81B and a gate plate 81C, opposing each other with the rotation shaft interposed therebetween.

When, as illustrated in FIG. 7A, a sheet P is transported over the fifth sheet transport path R5 at a position upstream of the merging point G2, the rotary gate 81 rotates so that the gate plate 81B protrudes over the sixth sheet transport path R6 at a position downstream of the merging point G2 and the gate plate 81C protrudes over the sixth sheet transport path R6 at a position upstream of the merging point G2.

Here, both gate plates 81B and 81C are disposed so as to extend along the fifth sheet transport path R5 at the merging point G2. Thus, even when the sheet P transported over the fifth sheet transport path R5 at a position upstream of the merging point G2 is directed to the sixth sheet transport path R6 at the merging point G2, the gate plates 81B and 81C restrict the transportation of the sheet P to the sixth sheet transport path R6. The gate plates 81B and 81C thus guide the sheet P to the downstream side of the fifth sheet transport path R5.

When, as illustrated in FIG. 7B, a sheet P is transported over the sixth sheet transport path R6 at a position upstream of the merging point G2, the rotary gate 81 rotates so that the gate plate 81B protrudes over the fifth sheet transport path R5 at a position upstream of the merging point G2 and the gate plate 81C protrudes over the fifth sheet transport path R5 at a position downstream of the merging point G2.

Here, both gate plates 81B and 81C are disposed so as to extend along the sixth sheet transport path R6 at the merging point G2. Thus, even when the sheet P transported over the sixth sheet transport path R6 at a position upstream of the merging point G2 is directed to the fifth sheet transport path R5 at the merging point G2, the gate plates 81B and 81C restrict the transportation of the sheet P to the fifth sheet transport path R5. The gate plates 81B and 81C thus guide the sheet P to the downstream side of the sixth sheet transport path R6.

In this manner, the rotary gate 81 composed of the gate plates 81B and 81C also restricts the transportation of the sheet P to either the fifth sheet transport path R5 or sixth sheet transport path R6 by protruding over either the fifth sheet transport path R5 or the sixth sheet transport path R6.

In addition, the rotary gate 81 protrudes over a transport path that is to be restricted at positions upstream of and downstream of the merging point G2. Thus, even when a curved sheet P arrives at the merging point G2, the sheet P is prevented from being transported to an upstream side of an unintended path.

In each of the configuration examples illustrated in FIGS. 6A to 7B, the rotary gate 81 covers an unintended sheet transport path while guiding a sheet P to the intended sheet transport path. Here, the rotary gate 81 does not have to cover the unintended sheet transport path as long as it guides the sheet P to the intended sheet transport path.

Instead of using the rotary gate 81, a wall surface constituting a sheet transport path may guide the sheet P to the intended sheet transport path.

Figure 8A:
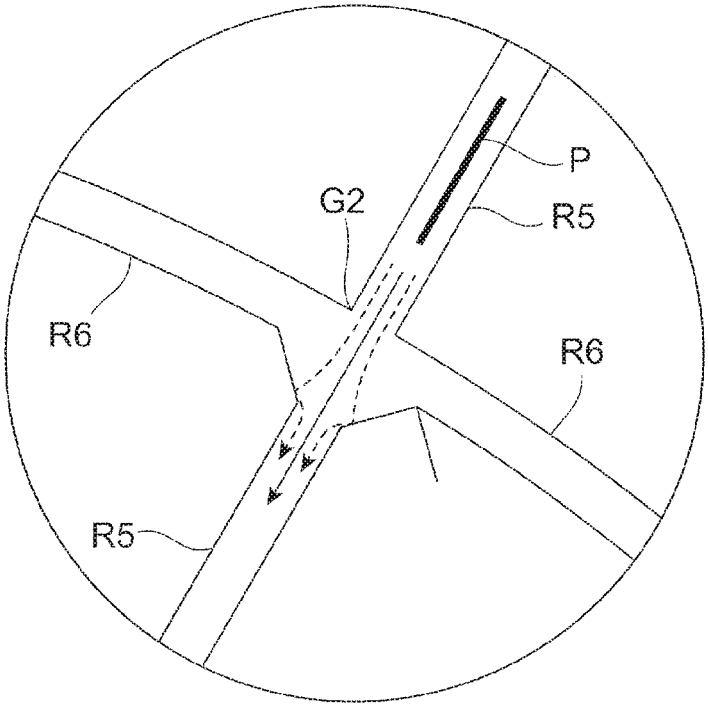
FIGS. 8A and 8B illustrate another example of the configuration for switching sheet transport paths at a merging point.
Figure 8B:
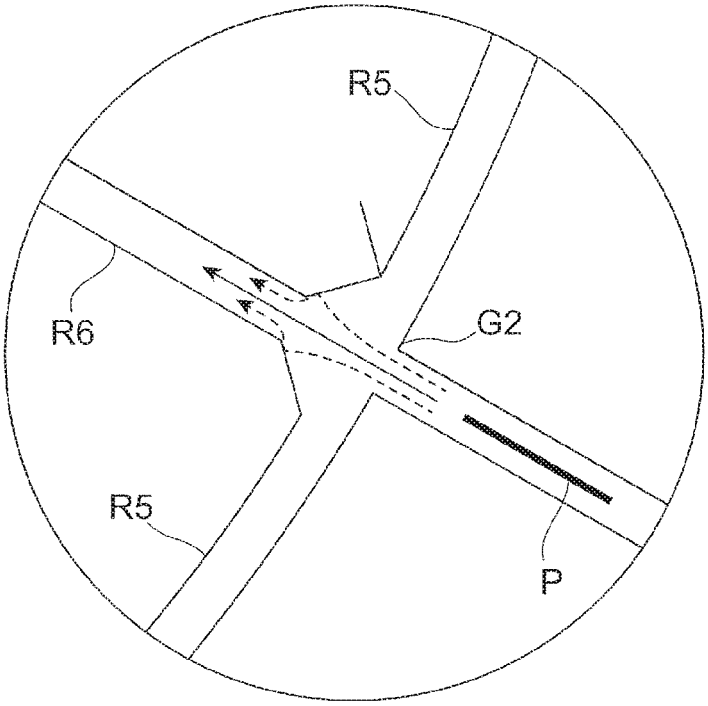

FIGS. 8A and 8B illustrate another configuration example for switching transport paths of sheets P at the merging point G2.

When, as illustrated in FIG. 8A, a sheet P is transported over the fifth sheet transport path R5 at a position upstream of the merging point G2, part of a wall surface constituting the fifth sheet transport path R5 located downstream of the merging point G2 is rotated, so that the width of the fifth sheet transport path R5 in a predetermined region downstream of the merging point G2 gradually decreases toward the downstream side. In addition, part of the wall surface constituting the sixth sheet transport path R6 located upstream of the merging point G2 is also rotated and retracted out of the sheet transport path. When the sheet P comes into contact with the wall surface constituting the fifth sheet transport path R5 within the predetermined region downstream of the merging point G2, the sheet P is transported along the wall surface to the downstream side of the fifth sheet transport path R5.

When, as illustrated in FIG. 8B, a sheet P is transported over the sixth sheet transport path R6 at a position upstream of the merging point G2, part of the wall surface constituting the sixth sheet transport path R6 located downstream of the merging point G2 is rotated, so that the width of the sixth sheet transport path R6 in a predetermined region downstream of the merging point G2 gradually decreases toward the downstream side. In addition, part of the wall surface constituting the fifth sheet transport path R5 located upstream of the merging point G2 is also rotated and retracted out of the sheet transport path. When the sheet P comes into contact with the wall surface constituting the sixth sheet transport path R6 within the predetermined region downstream of the merging point G2, the sheet P is transported along the wall surface to the downstream side of the sixth sheet transport path R6.

As described above, the configuration in which wall surfaces constituting sheet transport paths rotate enables guiding of sheets P to an intended sheet transport path and restricting transportation of sheets P to an unintended sheet transport path. In this configuration example, the wall surfaces constituting the fifth sheet transport path R5 and the wall surfaces constituting the sixth sheet transport path R6 are examples of the transport path switching portions.

Another Configuration Example of Reverse Transport Rollers

Another configuration example of the reverse transport rollers 74 and the third transport rollers 73 are described.

Figure 9:
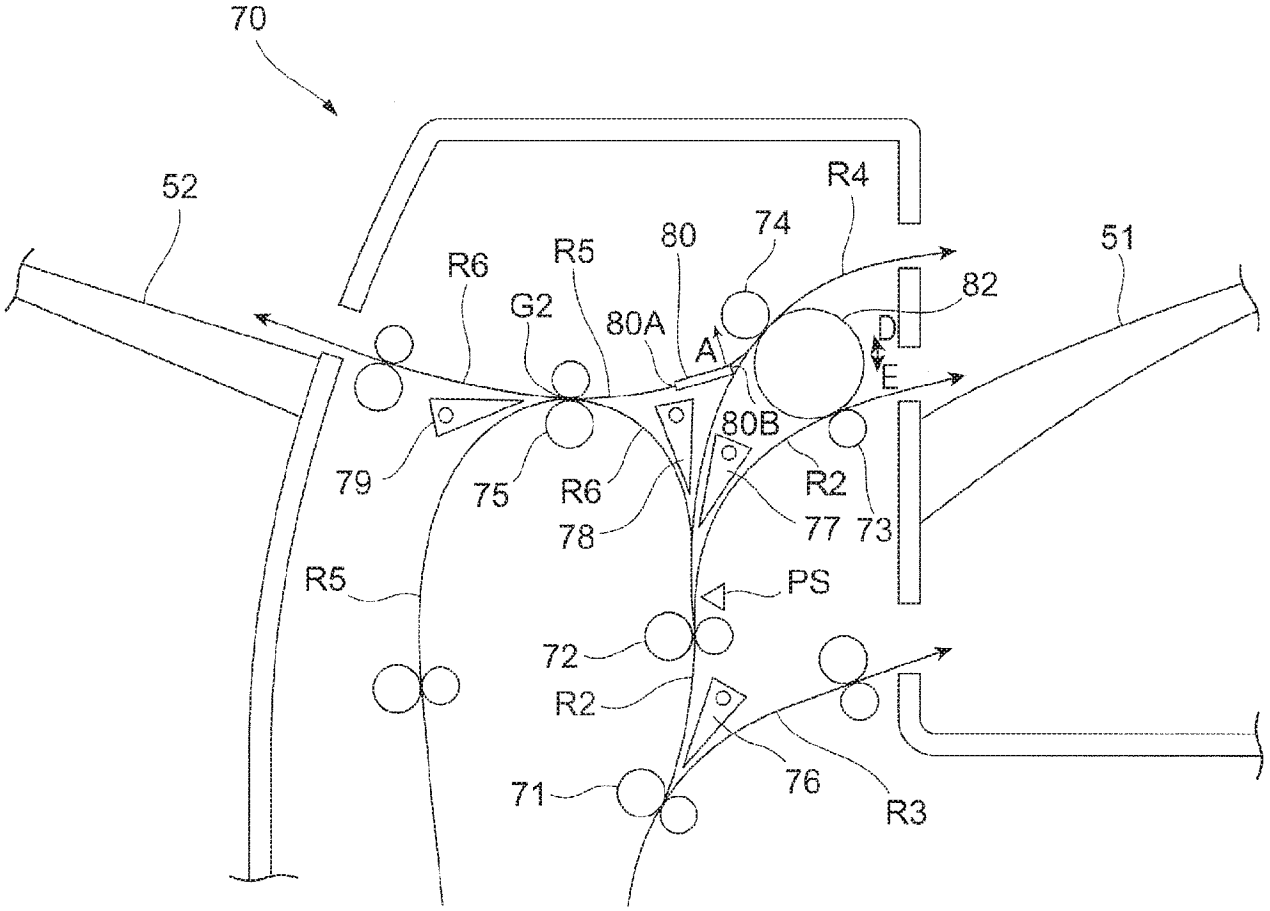
FIG. 9 illustrates another example of the configuration of a reverse roller and a third transport roller.

FIG. 9 illustrates another configuration example of the reverse transport rollers 74 and the third transport rollers 73. The components the same as those illustrated in FIG. 2 are denoted with the same reference symbols.

As illustrated in FIG. 9, a common-use roller 82 is used as an example of a common-use member to serve as a driving roller of the reverse transport rollers 74 and a driving roller of the third transport rollers 73, that is, a common-use roller 82 constitutes one of the reverse transport rollers 74 and one of the third transport rollers 73.

When the common-use roller 82 functions as one third transport roller 73, the common-use roller 82 rotates in the counterclockwise direction in FIG. 9 (direction of arrow D in FIG. 9) to eject the sheet P to the ejection tray 51. When, on the other hand, the common-use roller 82 functions as one reverse transport roller 74, the common-use roller 82 rotates in the clockwise direction in FIG. 9 (direction of arrow E in FIG. 9) to transport the trailing end of the sheet P to the downstream side of the one-way transport gate 80. Thereafter, the common-use roller 82 rotates in the direction of arrow D in FIG. 9 to transport the sheet P toward the diverging rollers 75.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image forming section configured to form an image on a recording medium;

a reverse transport portion configured to transport the recording medium in a reverse direction, which is opposite to a transport direction in which the image forming section is configured to transmit the recording medium to the reverse transport portion;

a first ejection portion configured to receive the recording medium ejected thereto and that is disposed on a downstream side of a second transport path in the transport direction, the second transport path diverging from a fourth transport path configured to transport the recording medium from the image forming section to the reverse transport portion;

a reverse transport path configured to transport the recording medium from the reverse transport portion to the image forming section, the reverse transport path not overlapping the second transport path configured to transport the recording medium from the image forming section to the first ejection portion; and a transport path switching portion configured to switch transport paths for the recording medium between a sixth transport path and the reverse transport path, wherein a second ejection portion is disposed on a downstream side of the sixth transport path in the transport direction, the second ejection portion disposed on a side of the image forming apparatus opposite to a side on which the first ejection portion is disposed, the sixth transport path diverging from the fourth transport path, and wherein the reverse transport path does not overlap the sixth transport path except for at a merging point at which the reverse transport path and the sixth transport path merge.

2. The image forming apparatus according to claim 1, further comprising:

a one-way guide portion continuous with the reverse transport path and disposed on the fourth transport path, the one-way guide portion configured to be elastically deformed when touching the recording medium transported from the image forming section to the reverse transport portion to guide the recording medium to the reverse transport portion, and the one-way guide portion configured to prevent the recording medium transported in the reverse direction by the reverse transport portion from returning along the fourth transport path.

3. The image forming apparatus according to claim 1, further comprising a divergent transport portion disposed at the merging point, the divergent transport portion configured to transmit the recording medium to the image forming section or the second ejection portion.

4. The image forming apparatus according to claim 2, further comprising a divergent transport portion disposed at the merging point, the divergent transport portion configured to transport the recording medium to the image forming section or the second ejection portion.

5. The image forming apparatus according to claim 1, further comprising a divergent transport portion disposed at the merging point at which the sixth transport path the divergent transport portion configured to transport the recording medium to the image forming section or the second ejection portion.

6. The image forming apparatus according to claim 2, further comprising a divergent transport portion disposed at a merging point, the divergent transport portion configured to transport the recording medium to the image forming section or the second ejection portion.

7. The image forming apparatus according to claim 1, wherein the transport path switching portion is disposed at the merging point, and the transport path switching portion is configured to rotate around a rotation axis to guide the recording medium to one of the sixth transport path and the reverse transport path and to prevent the recording medium from being transported to the other transport path.

8. The image forming apparatus according to claim 1, wherein the transport path switching portion is disposed at the merging point, and the transport path switching portion is configured to rotate around a rotation axis to guide the recording medium to one of the sixth transport path and the reverse transport path and to prevent the recording medium from being transported to the other transport path.

9. The image forming apparatus according to claim 1, further comprising:

a transport portion configured to eject the recording medium to the first ejection portion; and a common-use member configured to serve as a portion of the reverse transport portion and a portion of the transport portion, the common-use member ejecting the recording medium to the first ejection portion and transporting the recording medium in the reverse direction.

10. A recording medium transporting device, comprising:

a reverse transport portion configured to transport a recording medium in a reverse direction, which is opposite to a transport direction in which an image forming section, that forms an image on the recording medium, is configured to transport the recording medium to the reverse transport portion;

an ejection portion configured to receive the recording medium is ejected thereto and disposed on a downstream side of a second transport path in the transport direction, the second transport path diverging from a fourth transport path configured to transport the recording medium from the image forming section to the reverse transport portion;

a reverse transport path configured to transport the recording medium from the reverse transport portion to the image forming section, the reverse transport path not overlapping a second transport path configured to transport the recording medium from the image forming section to the ejection portion; and a transport path switching portion configured to switch transport paths for the recording medium between a sixth transport path and the reverse transport path, wherein a second ejection portion is disposed on a downstream side of the sixth transport path in the transport direction, the second ejection portion disposed on a side of the image forming apparatus opposite to a side on which the ejection portion is disposed, the sixth transport path diverging from the fourth transport path, and wherein the reverse transport path does not overlap the sixth transport path except for at a merging point at which the reverse transport path and the sixth transport path merge.

11. An image forming system, comprising:

an image forming section configured to form an image on a recording medium;

a reverse transport portion configured to transport the recording medium in a reverse direction, which is opposite to a transport direction in which the recording medium is transported to the reverse transport portion from the image forming section;

an ejection portion configured to receive the recording medium ejected thereto and disposed on a downstream side of a second transport path in the transport direction, the second transport path diverging from a fourth transport path configured to transport the recording medium from the image forming section to the reverse transport portion;

a subsequent-processing portion configured to perform a subsequent process on the recording medium on which the image has been formed;

a reverse transport path configured to transport the recording medium from the reverse transport portion to the image forming section, the reverse transport path not overlapping a second transport path configured to transport the recording medium from the image forming section to the ejection portion;

a controller configured to control transportation of the recording medium from the reverse transport portion to the image forming section; and a transport path switching portion configured to switch transport paths for the recording medium between a sixth transport path and the reverse transport path, wherein a second ejection portion is disposed on a downstream side of the sixth transport path in the transport direction, a second ejection portion disposed on a side of the image forming apparatus opposite to a side on which the ejection portion is disposed, the sixth transport path diverging from the fourth transport path, and wherein the reverse transport path does not overlap the sixth transport path except for at a merging point at which the reverse transport path and the sixth transport path merge.

12. The image forming apparatus according to claim 1, wherein the merging point comprises a first entrance, a second entrance, a first exit and a second exit each different from each other, the first entrance is configured to receive the recording medium along the reverse transport path and the first exit is configured to transmit the recording medium further along the reverse transport path, and the second entrance is configured to receive the recording medium along the sixth transport path and the second exit is configured to transmit the recording medium further along the sixth transport path.

* * * * *